US006269489B1

(12) United States Patent
Heath

(10) Patent No.: US 6,269,489 B1
(45) Date of Patent: Aug. 7, 2001

(54) HUNTING HOOD

(76) Inventor: Bradley J. Heath, 275 Kattelville Rd., Binghamton, NY (US) 13901

( * ) Notice: Subject to any disclaimer, the term of this patent is extended or adjusted under 35 U.S.C. 154(b) by 0 days.

(21) Appl. No.: 09/303,932

(22) Filed: May 3, 1999

(51) Int. Cl.[7] ..... A42B 1/04
(52) U.S. Cl. ..... 2/173; 2/202; 2/206; 2/171.4
(58) Field of Search ..... 2/206, 202, 4, 2/9, 417, 424, 205, 171.4, 173, 172, 171, 181, 181.4, 204, 207, 200.1, 84

(56) References Cited

U.S. PATENT DOCUMENTS

| | | | | |
|---|---|---|---|---|
| 603,306 | * | 5/1898 | Weil | 2/4 |
| 1,087,418 | * | 2/1914 | Zucker | 2/4 |
| 2,189,892 | * | 2/1940 | Fox | 2/4 |
| 3,823,418 | * | 7/1974 | Piper | 2/206 |
| 4,285,068 | * | 8/1981 | Ross | 2/202 |
| 4,484,362 | * | 11/1984 | Asher | 2/69 |
| 4,573,217 | * | 3/1986 | Reed | 2/202 |
| 5,091,996 | * | 3/1992 | Kirby | 2/206 |
| 5,146,622 | * | 9/1992 | Blustein | 2/202 |
| 5,251,336 | * | 10/1993 | Nevins | 2/202 |
| 5,339,466 | * | 8/1994 | McMullen | 2/203 |
| 5,575,009 | | 11/1996 | Ryvin . | |
| 5,815,849 | * | 10/1998 | Maletich | 2/427 |

* cited by examiner

*Primary Examiner*—Amy B. Vanatta
(74) *Attorney, Agent, or Firm*—Salzman & Levy

(57) ABSTRACT

A hunting hood is described that can be worn on the head of a hunter, in both summer and winter. The hood has several comfort-providing features, such as an adjustable eye window and an attachable and detachable hinged flap for exposing an opening for the mouth of a hunter. These adjustable features allow the hood to be contoured to the face of each individual hunter.

3 Claims, 3 Drawing Sheets

HUNTING HOOD

FIELD OF THE INVENTION

The present invention relates to hunting apparel and, more particularly, to an extended wear, hunting hood having a mouth opening and comprising gauzy, porous material for allowing perspiration to escape freely through the pores to provide cooling comfort to the hunter in summer, while retaining enough body heat during winter. The hood has the capability to adjust the fit to the face of the user to provide comfort over extended periods of wear.

BACKGROUND OF THE INVENTION

Hunters waiting in a blind for their prey to arrive are often poorly dressed for the task. Over extended periods of time, their wearing apparel frequently becomes uncomfortable. This is particularly exacerbated by using hunting masks or hoods. Hunting masks or hoods are embossed with camouflaging markings to help disguise the hunter, so that he or she may blend in with the forest surroundings. Animals and birds have acute sensory capabilities to spot or sense enemies at extended distances. Any slight movement or dislocation is often enough to spook the hunted prey, causing them to evade and avoid capture.

Masks and hoods capture body heat. A hunter is usually bothered by sweat, when wearing a hood or a mask over long periods of time. The hunter is forced to endure the discomfort, since any twitching movement may alert the prey.

Another common problem with hunting masks is their inability to adjust to the face or head of the individual. Hoods and masks are often ill-fitting, causing additional discomfort over extended periods of time. The discomfort is felt most about the eyes, where sweat build-up can cause perspiration droplets to sting the eyes.

Still a further problem with hunting hoods is their lack of a mouth opening. Mouth openings are usually not designed into a mask or hood. The reason for this omission may be that steam emanating from the mouth or nostrils of the hunter in cold weather can be spotted by various prey. Often hunters may wish to take a drink, eat, or expectorate. Having put on the mask or hood, the hunter does not relish having to remove the hood for these purposes; nor is removing the hood entirely or even partially a good idea in the presence of sensitive prey.

An additional problem with hoods and masks, is the materials used in their construction. Masks or hoods designed with quilting for winter use cannot be worn during the summer.

The present invention seeks to address the aforementioned problems. The hunting hood of the present invention comprises a diaphanous material, such as a gauze. The gauze is light and comfortable, so that extended periods of wear can be endured easily. Gauze can capture enough heat in winter to keep the face and head warm. In summer, the gauze is light enough to dissipate the heat in order to cool the head and face of the hunter. The gauze allows perspiration in the form of heated water vapor to escape from the hood through the pores of the material. The hood of this invention is able to capture body heat in winter, without producing the annoying discomfort of running droplets of perspiration.

The current invention also provides a hunting hood whose eye window is adjustable for comfort. The eye window of the inventive hunting hood can be shaped and reformed to the eye and nose contours of the face. Some hunters enjoy a wider opening about the eyes, whereas others may prefer a narrower opening. Moreover, as the mouth opening is aligned with the mouth of the wearer, the eye opening(s) may shift. The hood of this invention allows adjustments to be made for each individual.

The present invention additionally provides a hunting hood with a mouth opening. The opening comprises a flap that is held in place at its rim by adhesive-like material, such as Velcro® material. The flap, once removed from the adhesive constraint, hangs from the hood about a lower hinge. The hinged flap allows the hunter to eat or drink without removing the entire hood or even a portion thereof. After alleviating hunger or thirst, the hunter reapplies the flap to the mating adhesive material, and fixes it in place. Thus, the hood of this invention provides additional wearer comfort during the wait.

The inventive hood can also comprise a removable inner liner of back-to-back silvered and darkened material. The liner can be used to provide additional warmth or cooling.

DISCUSSION OF RELATED ART

In U.S. Pat. No. 5,575,009 issued to Ryvin on Nov. 19, 1996, for a COLD WEATHER FACE MASK AND HOOD, a hunting hood and mask is illustrated that features a mask that can be lifted above the eyes of the hunter. The mask is held in place about the mouth area by an elastic strap. The elastic strap is secured to the hood by a retainer strap located at the back of the hood. The hood and mask are made of quilted materials that provide warmth in winter. It should be observed that this mask cannot be worn in comfort during the summer, since the quilting will capture perspiration and excessive body heat. Nor can the wearer access his or her mouth unless at least the lower portion of the mask and hood is removed.

SUMMARY OF THE INVENTION

In accordance with the present invention, there is provided a hunting hood for extended wear during both summer and winter. The hood of the invention comprises a diaphanous, gauze-like material that will dissipate heat, water vapor and sweat through its pores during summer. The gauze captures enough body heat to provide hunting comfort during winter. The hood has an adjustable eye window, in order to fit the hood comfortably to a variety of users. The adjustable eye window comprises a single, oval-shaped cloth rim that contains an internal, bendable wire. The wire can be adjusted to different shapes and the hood can be adjusted relative to the wearer, making the eye window larger or narrower to fit the user's comfort. Below the eye window, the hood contains a hinged flap. The flap can be pulled downwardly to reveal an opening for the mouth. The opening allows for the consumption of comestibles, drinks, and other mouth related activities. The flap is held in place by an adhesive-like material that is integrally stitched intermittently about the rim of the flap above the stitched hinge. The adhesive-like material, such as Velcro® liners, comprise mating hooks and loops common in wearing apparel.

Adjustment of the eye window changes the position of the flap about the mouth. Thus, the eye window comprises the dual purpose of both providing comfort about the eye portion of the face and securing a proper fit about the mouth section.

The inventive hood can also include a removable inner liner, as an optional feature. The inner liner can comprise a back-to-back silvered and darkened material and can be used to provide additional warmth or cooling.

It is an object of this invention to provide an improved hunting hood.

It is a further object of the invention to provide a hunting hood having a mouth opening.

It is another object of the invention to provide a hunting hood that can be worn in comfort in both summer and winter, and which adjusts to the facial features of the user.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same designation and numbering throughout all the figures.

DESCRIPTION OF THE PREFERRED EMBODIMENT

Generally speaking, the invention features a hunting hood that can be worn on the head of a hunter, in both summer and winter. The hood comprises several comfort-providing features, such as an adjustable eye window and an attachable and detachable hinged flap for exposing an opening for the mouth of a hunter. These adjustable features allow the hood to be contoured to the face of each individual hunter.

Figure 1:
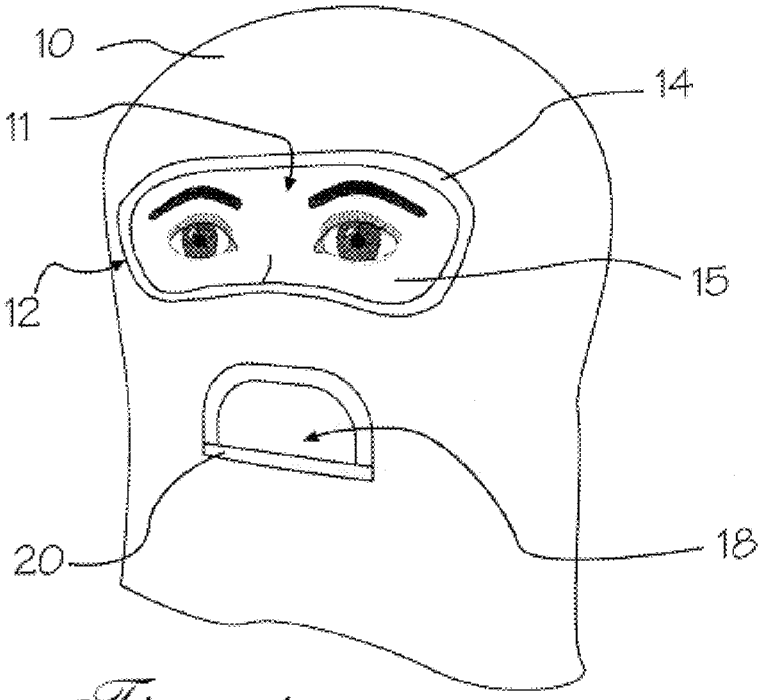
FIG. 1 illustrates a perspective, in situ view of the hunting hood of this invention with the mouth flap closed.
Figure 2:
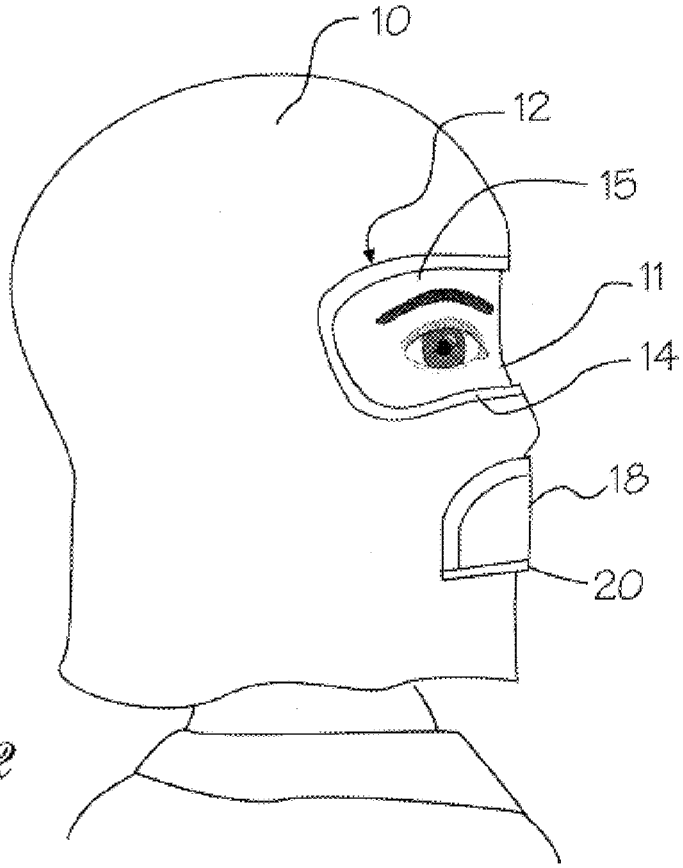
FIG. 2 depicts a side, in situ view of the hunting hood, shown in FIG. 1.

Now referring to FIGS. 1 and 2, the hunting hood 10 of this invention comprises an adjustably deformable eye window 12. The hood 10 comprises a diaphanous sheet of material, such as a gauze, which allows heated water vapor and perspiration to escape through its pores, while retaining a good portion of body heat. The eye window 12 is defined by a hollow cotton strip 14, which defines a single, substantially oval-shaped or elliptical, open spaced window 11, for the eyes of the face 15 of a hunter.

Figure 4:
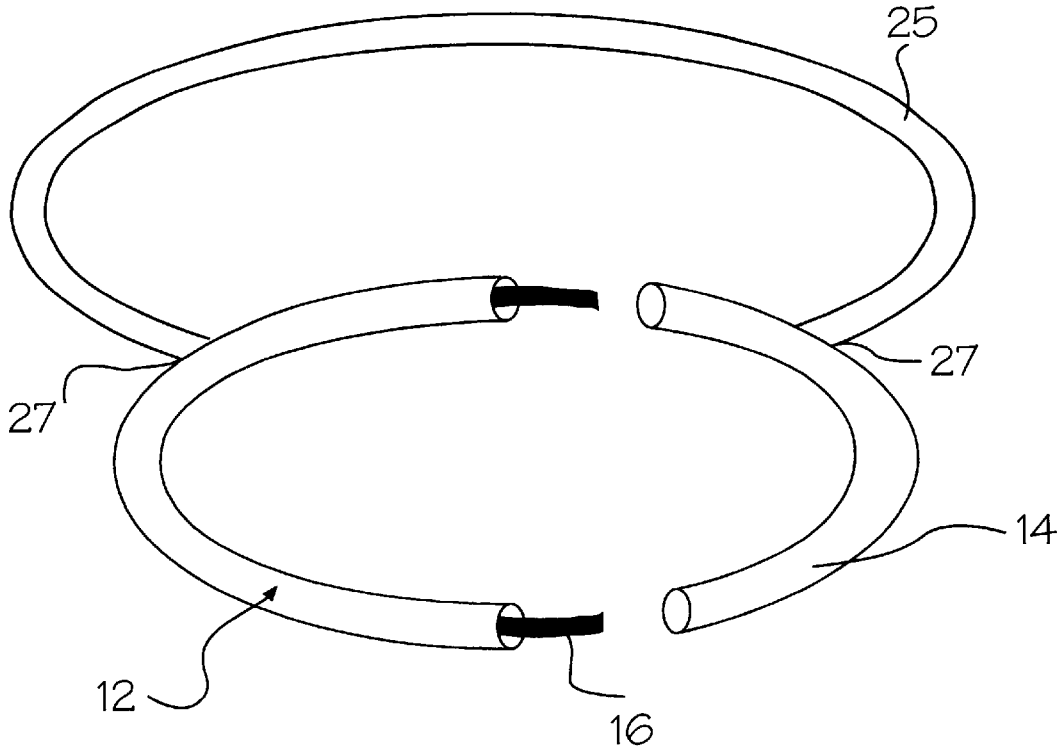
FIG. 4 illustrates a cut-away frontal view of the eye window lining of the hunting hood, shown in FIG. 1.

The cotton strip 14 is shown in greater detail in the cut-away view of FIG. 4. The hollow cotton strip 14 is sewn into the hood 10, and contains an internal bendable wire 16, which allows the open spaced window 11 to be adjusted and contoured into a larger or narrower shape.

The hood 10 also comprises a flap 18, which is disposed about the mouth 19 (FIG. 3) of the wearer's face 15. FIGS. 1 and 2 show the flap 18 in its normally closed position, wherein the mouth 19 of the hunter is covered by the flap 18.

Figure 3:
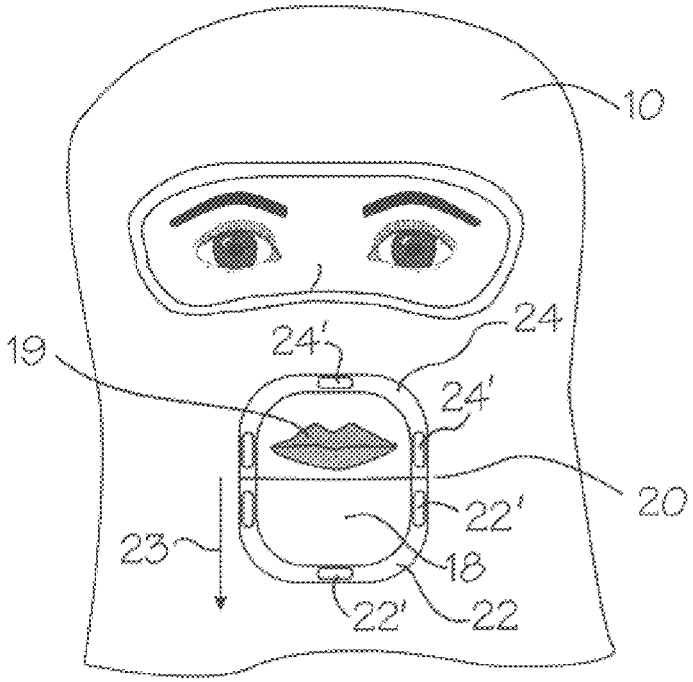
FIG. 3 shows a frontal, perspective, in situ view of the hunting mask depicted in FIG. 1, with the mouth flap open, and hanging about its hinge.
Figure 3A:
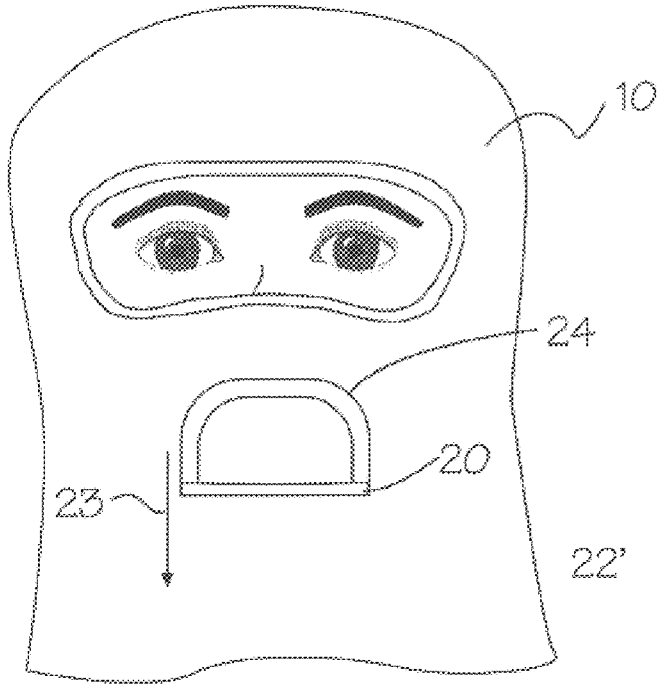
FIG. 3*a* shows a frontal perspective view of another embodiment of the hunting mask of the invention.

Referring also to FIG. 3, the flap 18 of hood 10 is illustrated in its open position. The flap 18 comprises a strip of gauze material that is articulately attached to the hood 10 about a hinge, such as a stitched strip 20. The substantially square-shaped border strip 22 of flap 18 comprises portions of an adhesive material 22' that mates with corresponding portions 24' of the square-shaped border strip 24 stitched to the hood 10. The mating materials 22' and 24', respectively, comprise hooks and loops, as is commonly known in the apparel arts as Velcro® material. Access to the mouth 19 is accomplished by pulling the flap 18 in a downward direction, as shown by arrow 23. The flap 18 can be reattached about the mouth area (FIG. 3*a* ) by aligning respective adhesive strips 22 and 24, and then pushing them into mating contact, as is well known in the apparel art.

As shown, the adhesive portions 22' and 24' of strips 22 and 24, respectively, need not be continuous, although they can be continuous. In fact, to reduce noise associated with the opening/closing operation of the flap 18, intermittently placed portions or even button-like patches 22' and 24' are spaced along the periphery of flap 18, shown in FIG. 3.

Referring again to FIG. 4, the cotton window strip 14 is shown having an elastic band 25 attached at the respective apogees 27 of the oval window 12. The elastic band 27 is disposed on the inside of hood 10 and is placed over the head of the hunter, from the inside of the hood 10. The elastic band ensures that the eye window 12 fits snugly about the eyes of the hunter.

Adjustment of the wire 16 within the hollow cotton strip 12 contorts the hood 10, such that the mouth flap 18 disposed below the window 11 will be forced to relocate its position adjacent the mouth 19. Thus, the adjustment of the window 12 will also serve the purpose of adjusting the mouth flap position upon the hood 10.

Figure 5:
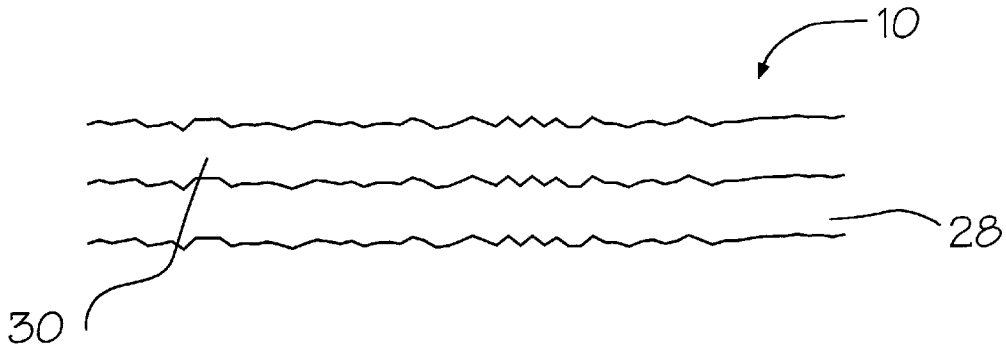
FIG. 5 depicts a partial, cross-sectional view of the hood material with a removable liner.

Referring to FIG. 5, a cross-section of the hood 10 of the invention is illustrated. The inventive hood 10 can comprise a removable inner liner 28, as an optional feature. The inner liner 28 can be attached by Velcro® material, not shown, in similar fashion to that of flap 18. The inner liner 28 can comprise a back-to-back silvered and darkened material: adjacent sides comprising respective silvering and darkened coloring. The liner 28 can be used to provide additional warmth or cooling depending upon the placement of the silvering or darkening on the inner surface 30 of the hood 10.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A hunting hood that covers, and is worn over an entire head portion of a hunter in order to camouflage same for hunting purposes, comprising a diaphanous, porous sheet of material fashioned in the shape of a hood, and means defining a mouth opening comprising a hinged flap member that is attachable and detachable to said sheet of material by adhesive means, thus allowing access to said mouth opening, a removable liner disposed inside said porous sheet, said removable liner comprising a silvered side and a darkened adjacent side, said silvered side being adjacent said porous sheet, and said darkened adjacent side being disposed opposite said entire head portion, said silvered side of said removable liner providing cooling by reflecting outside heat in summer, and said darkened adjacent side retaining heat in winter, and further wherein said sheet of material comprises an eye window having an adjustable means configured about an eye portion of said hood, said adjustable means including a deformable wire circumscribing said eye window, said adjustable means allowing said hunter to adjust said eye window of said hood in order to conform with facial contours of said hunter about said eye portion.

2. The hunting hood in accordance with claim 1, wherein said eye window is substantially elliptically shaped.

3. The hunting hood in accordance with claim 1, wherein said flap member is hingedly stitched to said hood, and further comprising adhesive material disposed about a periphery of said flap member for attachment to said hood.

* * * * *